United States Patent [19]

Wilkinson

[11] Patent Number: 4,543,657

[45] Date of Patent: Sep. 24, 1985

[54] SYNCHRONIZING OF CLOCKS

[75] Inventor: Robert G. Wilkinson, Portsmouth, England

[73] Assignee: The Secretary of State for Defence in Her Britannic Majesty's Government of the United Kingdom of Great Britain and Northern Ireland, London, England

[21] Appl. No.: 380,736

[22] PCT Filed: Sep. 15, 1981

[86] PCT No.: PCT/GB81/00190

§ 371 Date: May 12, 1982

§ 102(e) Date: May 12, 1982

[87] PCT Pub. No.: WO82/01088

PCT Pub. Date: Apr. 1, 1982

[30] Foreign Application Priority Data

Sep. 16, 1980 [GB] United Kingdom ..... 8029893

[51] Int. Cl.[4] ..... G04G 9/00; G04G 7/00

[52] U.S. Cl. ..... 375/1; 368/47; 375/115

[58] Field of Search ..... 375/1, 115; 370/100, 370/107; 368/47, 48; 371/42, 47; 328/63, 72

[56] References Cited

U.S. PATENT DOCUMENTS

| | | | |
|---|---|---|---|
| 3,244,808 | 4/1966 | Roberts | 375/115 |
| 3,648,173 | 3/1972 | Elliott | 368/47 |
| 3,756,012 | 9/1973 | Kiss | 368/47 |
| 3,823,377 | 7/1974 | Keane et al. | 370/107 |
| 3,852,534 | 12/1974 | Tilk | 370/107 |
| 3,861,134 | 1/1975 | Chacon et al. | 368/48 |
| 4,014,166 | 3/1977 | Cateora et al. | 368/47 |
| 4,112,368 | 9/1978 | Ewanus et al. | 375/1 |
| 4,117,661 | 10/1978 | Bryant, Jr. | 368/47 |
| 4,122,393 | 10/1978 | Gordy et al. | 375/1 |
| 4,158,193 | 6/1979 | D'Antonio | 371/47 |

FOREIGN PATENT DOCUMENTS

| | | |
|---|---|---|
| 1414875 | 11/1975 | United Kingdom . |
| 1518892 | 1/1977 | United Kingdom . |
| 1517661 | 7/1978 | United Kingdom . |
| 1526467 | 9/1978 | United Kingdom . |
| 2019054 | 10/1979 | United Kingdom . |

OTHER PUBLICATIONS

Sharma, "Application of Redundant Codes to a Digital Communication System", Proc. Nat. Electronic Conf., No. 16 (1960) p. 243.

Townsend & Watt, "Effectiveness of Error Control in Data Communication Over the Switched Telephone Network", by The Bell System Technical Journal, Nov. 1964, pp. 2632–2633.

*Primary Examiner*—Robert L. Griffin

*Assistant Examiner*—Stephen Chin

*Attorney, Agent, or Firm*—Cushman, Darby & Cushman

[57] ABSTRACT

A time clock modem transmitter comprises a pseudo-random number generator (PNG) which produces a time-spaced sequence of pseudo-random numbers such that each number uniquely represents the time of day. A transmitter PNG(11) capable of producing a polynomial sequence longer than 24 hours is reset every 24 hours by a transmitter reference clock (4). A receiver clock modem includes a receiver PNG(26) having the same polynomial characteristics as the transmitter PNG(11). A received signal number is fed into the receiver PNG and the PNG is then started. The output from the receiver PNG and the received signal are then compared to ensure correct synchronization of the receiver clock modem. A detector is provided which is responsive to the random number representing 2400 hours such that it produces a resetting output pulse at 2400 hours to reset a receiver reference clock. Clock pulse generators 19 and 28 are provided to rapidly advance by one cycle on actuation the reference clock and PNG respectively in the transmitter and the receiver for resetting the clocks.

9 Claims, 9 Drawing Figures

SYNCHRONIZING OF CLOCKS

BACKGROUND OF THE INVENTION

The invention relates to the standardization of clocks as is required for example in modern communications systems.

In the field of communications, particularly where net-working systems are used, there is frequently a need to acquire and then maintain over long periods of time an accurate time-signal reference to operate electronics communications equipment.

Modern atomic frequency standards are readily available having drift rates of 1 in $10^{12}$ which can maintain an accurate reference over a long period of time without the need for frequent checking or correcting. The difficulty experienced in standardizing distant clocks is to obtain a sufficiently accurate synchronizing time-signal. Generally, current net-working systems require an accuracy of only better than 1 second as they run at relatively low band rates and/or they have been specifically designed to operate from such timing sources. However recent developments in HF/VHF communication systems indicate that timing accuracies within the range of 100 microseconds to 10 milliseconds will be necessary.

The requirement for a time signal source can be met at present using a reasonably stable clock and a standard time signal transmission such as MSF, WWV or GBR etc. The high speed time codes used by these services are transmitted in short bursts one per minute on the minute. The transmitted sequence contains a simple framing preamble followed by a 100 band data code giving GMT and the date. Although in principle a simple serial to parallel conversion is all that is required to decode the information contained in these transmitted codes in practice sophisticated error checking would be essential to discriminate against unwanted signals and to avoid erroneous decoding.

Errors in time code acquisition can occur because of poor propagation or high interference levels which frequently pervade the HF radio spectrum. The accuracy with which the time code signal can be received will depend on the signal to noise ratio of the transmitted time signal, the band width of the receiver and the coding format.

SUMMARY OF THE INVENTION

The object of the present invention is to provide a time code modem which adopts a special modulating technique to provide a timing accuracy which is better than has been previously possible for a given bandwidth.

In one form the invention provides a transmission clock modem for transmitting time-coded signals which comprises:

- a transmission pseudo-random number generator (PNG) to generate a train of pseudo-random numbers;
- pulse generator means to produce clocking pulses for connection to the transmission PNG such that the output numbers from the transmission PNG are equi-spaced in time;
- resetting means connected from the reference clock to the transmission PNG such that the transmission PNG is reset to a predetermined condition, hereinafter referred to as zero, after a preselected time interval: and

- means to transmit the output from the transmission PNG.

PNG's are well known circuits which produce an apparently random series of encoded numbers up to a maximum number which then repeats cyclically. Thus by making an appropriate choice of transmission PNG, clocking pulse rate and preselected time interval the total of pseudo-random numbers within the train of numbers can be kept within the maximum possible number for the PNG and therefore each number in the train will uniquely define the time within the preselected time interval.

Preferably the resetting means comprises a transmission reference clock which produces an output resetting pulse at the end of each of the preselected time intervals.

Advantageously the time interval is 24 hours. Thus after the PNG output is a number representative of 2400 hours the PNG is reset and the random number train starts again from zero.

In order to synchronize the transmission PNG and the transmission reference clock there is provided a pulse generator which can be actuated to add to the transmission PNG a number of clocking pulses equal to the number of pseudo-random numbers which can be generated by the transmission PNG within the preselected time interval and to simultaneously advance the transmission reference clock by the preselected time interval. By thus advancing both the PNG and the transmission reference clock through one complete cycle synchronism is achieved as the PNG is reset to zero during the cycle when the clock passes 2400 hours, say, and the clock and the PNG then continue to the end of the cycle when the transmission reference clock will return to the correct time with synchronism maintained.

The invention also provides a clock modem receiver for deriving the time from a transmitted series of time coded signals represented by a train of pseudo-random numbers comprising:

- a receiver pseudo random number generator (PNG) capable of producing an output train of pseudo-random numbers identical with the transmitted train of pseudo-random numbers; a clocking pulse generator connected to the receiver PNG such that the receiver PNG is clocked at the same rate as the transmitted signal;
- a detector to receive the transmitted train of pseudo-random numbers;
- a synchronizing control circuit to synchronize the receiver PNG to the received train of pseudo-random numbers; and decoding means to derive the time from the output of the receiver PNG.

Preferably the receiver includes a receiver reference clock, and a detector responsive to the number generated by the receiver PNG representative of the end of the preselected time interval to produce an output signal to reset the receiver reference clock.

Advantageously the transmitter and receiver PNGs comprise shift registers having at least one feed-back loop. The synchronizing control circuit then includes means to feed the received time-coded pseudo-random numbers signal into the receiver.

PNG shift register and switching means operable between a first position in which the feedback loop is disconnected while the received pseudo-random numbers signal is fed into the receiver PNG shift register, and a second position in which the received signal is disconnected from the receiver PNG shift register and the feedback loop is connected.

Thus if the received signal is error free and identical to the transmitted signal, once the receiver PNG feedback loop is reconnected the receiver PNG output will be synchronized with the received pseudo-random numbers signal. It is necessary to set the receiver reference clock with reference to the receiver PNG output so as to derive the time. As in the transmitter, there is preferably provided in the receiver a receiver pulse generator which is capable of being actuated to add to the receiver PNG a number of clocking pulses equal to the number of pseudo-random numbers which can be generated in the preselected time interval and to advance the receiver reference clock by the preselected time interval to thereby synchronize the receiver PNG and the receiver reference clock.

The received signal may however include bit errors which will result in a false time registration once the acquired signal is stored in the shift register of the receiver PNG and the PNG started. The receiver therefore preferably includes comparator means to check the synchorinzation of the output from the receiver PNG and the received pseudo-random numbers. The comparator means may include an error counter to count the proportion of bit errors, a discriminator to produce and output when the proportion of bit errors exceeds a predetermined threshold and a re-synchronization control operative on receiving an output from the discriminator to reconnect the received signal to the receiver PNG shift register.

In order to speed up the synchronization checking it is possible to provide a high speed recirculating shift register at the input of the receiver clock modem connected such that once the receiver PNG is switched on after acquisition of a first block of received time-coded signal bits the next block of received time-coded signal bits can be stored and rapidly circulated together with the output from the receiver PNG, such that the checking can be done off-line at high speed.

An independent battery-operated clock may be advantageously included in the receiver clock modem so that absolute time and relative time may be determined by respective reference to the battery clock and the transmitter clock-derived time. The provision of a battery-operated clock also gives the receiver clock modem an independence from the mains supply so that the clock modem can be transported without loss of time information.

The accuracy with which the receiver clock can record the time from the received coded time signal can be improved by providing a sub-bit time resolver. This is done by cross correlating the received time signal with the receiver PNG output and determining the time delay which gives the maximum cross-correlation.

BRIEF DESCRIPTION OF DRAWINGS

The invention will now be described by way of example only with reference to the accompanying drawings of which.

DESCRIPTION OF PREFERRED EMBODIMENTS

Figure 1:
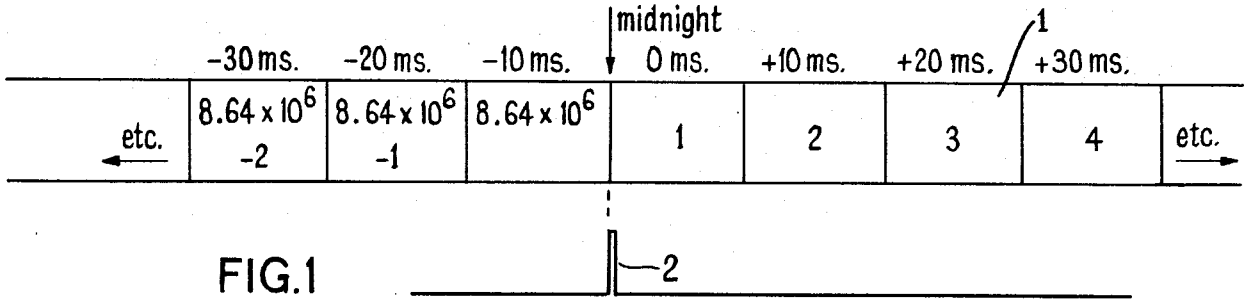
FIGS. 1 and 2 illustrates the time-derived polynomial.
Figure 2:
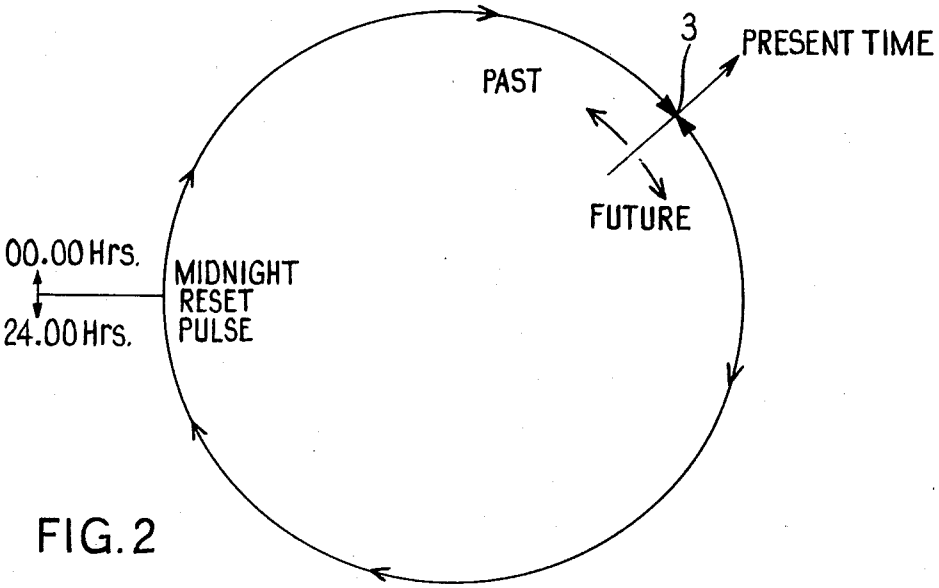

The time clock modem comprises a transmitter clock modem which includes an internal 24-hour reference clock to provide timing pulses to uniquely time-synchronize a pseudo-random binary data signal from a transmitter pseudo-random number generator (PNG). The time-coded data signal is then transmitted for reception by a receiver clock modem which decodes the received coded signal in real time to find the time of day. If a resolution of $\pm 5$ milliseconds ($\pm\frac{1}{2}$ bit) is to be achieved the bit rate of the data signal will have to be 100 bauds. The length of a 24-hour polynomial or pseudo-random number sequence required to produce this time resolution will therefore be 8,640,000 bits long and this sequence will uniquely define a 24-hour clock. FIGS. 1 and 2 show how the polynomial sequence can be used to represent time. The pseudo-random number sequence 1 is produced at intervals of 10 msec by means of a PNG chosen to have a polynomial length greater than $8.64\times10^6$.

PNG's operate cyclically having a maximum number, equal to the polynomial length, of different pseudo-random numbers which can be sequentially generated before those numbers are cyclically repeated. Thus to uniquely represent the time of day the time taken to generate this maximum number must exceed 24 hours. Once every 24 hours, at midnight for example, the PNG is then reset to zero by means of a reset pulse 2 from the internal reference clock so that the sequence of pseudo-random numbers generated during a 24-hour period is repeated and each number will then uniquely represent the time of day. The PNG comprises a 25-stage shift register, with a single modulo-two feedback network taken from the 23rd stage. This provides the required polynomial length for the PNG such that the time 3 is then uniquely specified by a particular sequence of 25 bits immediately preceeding that time.

Figure 3:
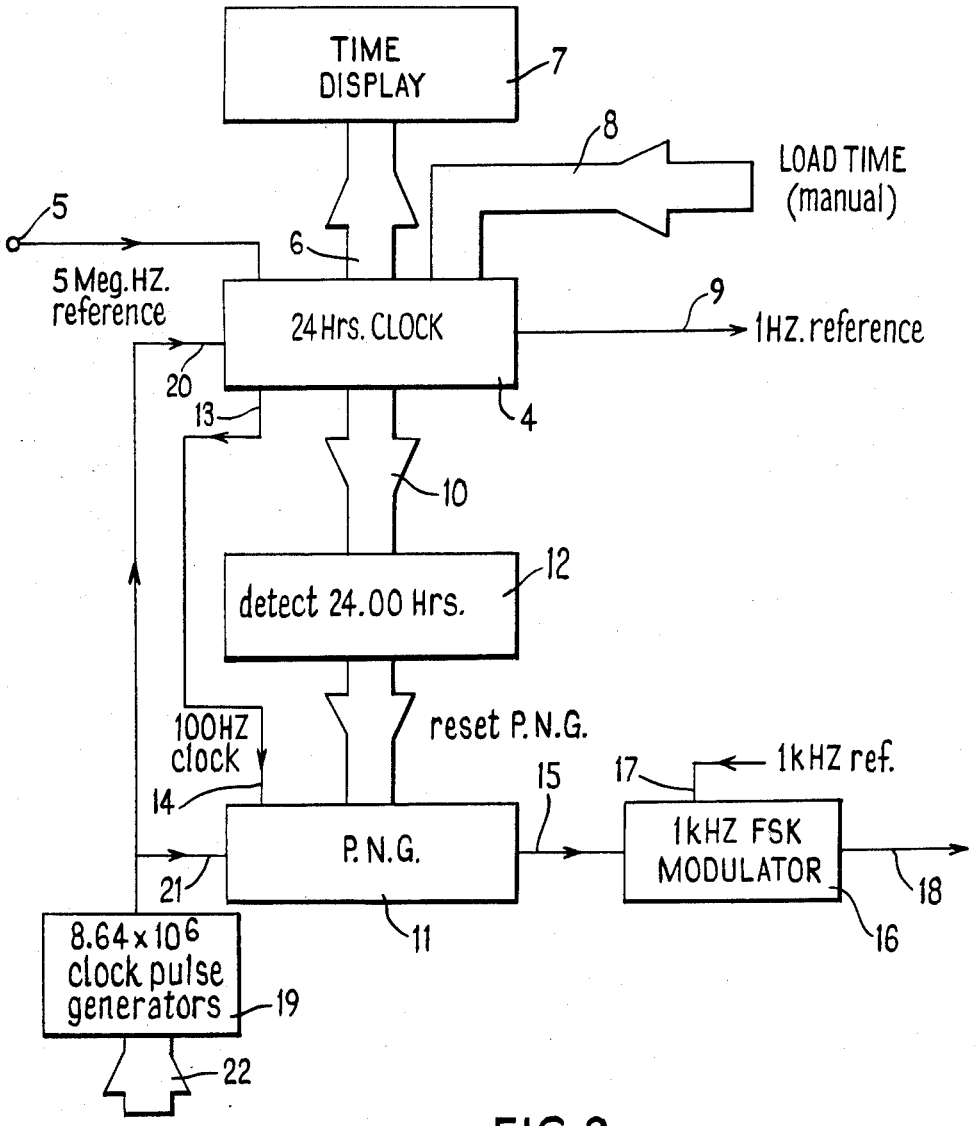
FIG. 3 is a schematic block diagram of a transmitter clock modem using the polynomial.

FIG. 3 shows diagrammatically how the transmitter clock modem operates. A 24-hour clock 4 is driven from a 5 $MH_z$ reference source connected to input 5. A first output 6 from the 24-hour clock 4 is connected to a liquid-crystal display (LCD) 7 which is used to monitor the 24-hour clock time so that it can be set up using the manual load time facility 8. A 1 Hz reference signal is provided at a second output 9 for the purpose of assisting in setting the clock. A third output 10 from the 24-hour clock 4 is used to provide the reset pulse 2 to reset the transmitter PNG 11. When the 24-hour clock 4 registers 2400 hours the detector 12 produces a reset pulse which is connected to the transmitter PNG 11. A fourth output 13 from the 24-hour clock 4 is connected to a clocking input 14 of the transmitter PNG 11. The clocking rate is such that a pseudo-random data sequence at 100 bits per sec is provided at the output 15 of the transmitter PNG 11. The length of this pseudo-random date sequence is $8.64\times10^6$ bits since the transmitter PNG is reset every 24 hours and then the sequence repeats. The transmitter PNG output 15 is connected to a Frequency Shift Keying (FSK) modulator 16 which has a 1 $KH_z$ reference signal applied to an input 17. The FSK modulator 16 produces a 1 $KH_z$ sub-carrier modulated signal having a deviation ratio of approximately 0.3 at the output 18 of the transmitter clock modem. Once the 24-hour clock 4 is set to the correct time the transmitter PNG 11 can be synchronized with the 24-hour clock 4 by advancing the 24-hour clock 4 and the transmitter PNG 11 at high speed through settings corresponding to a period of time equivalent to exactly 24 hours by applying to the 24-hour clock 4 and the transmitter PNG 11 a train of $8.64\times10^6$ pulses. A clock pulse generator 19 is connected to the drive inputs 20 and 21 of the clock and the transmitter PNG respectively and is so arranged that on depressing a PNG synchronization button 22 a train of $8.64\times10^6$ pulses is generated at a frequency of 500 KHz. This synchronization operation therefore takes about 18 secs.

Figure 4:
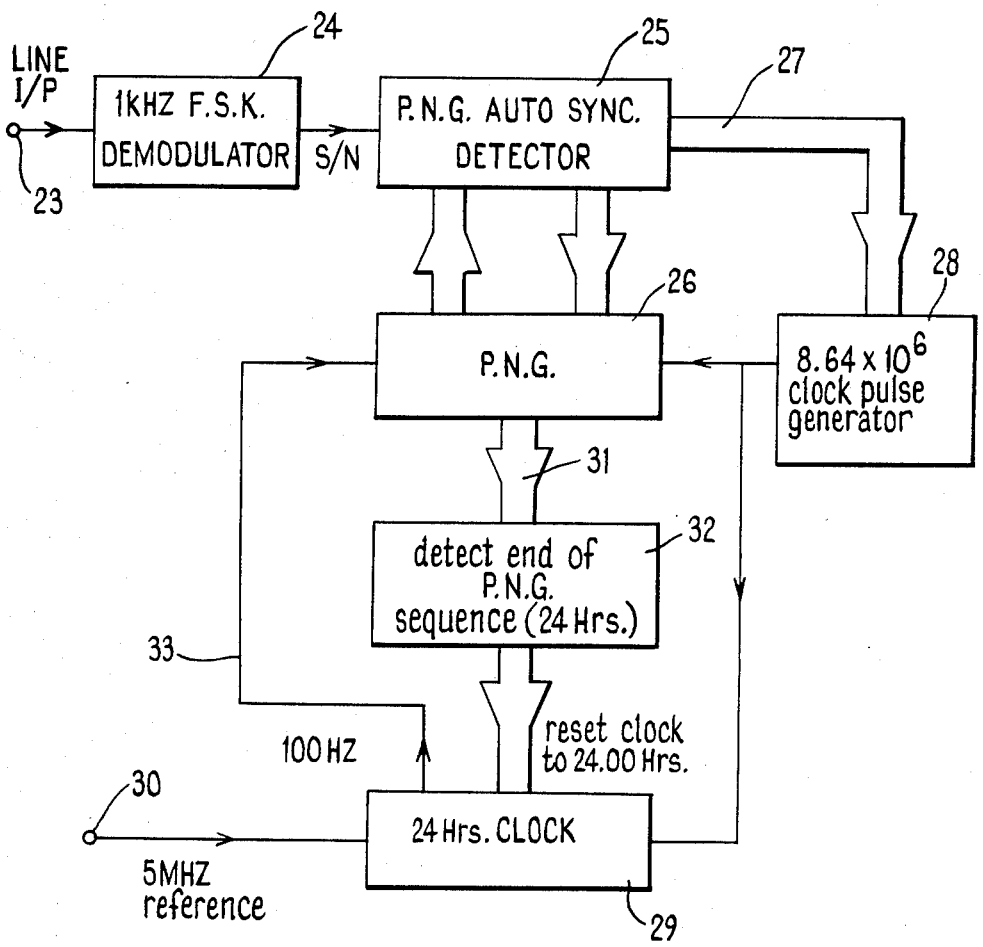
FIG. 4 is a block diagram of a receiver clock modem for use with the transmitter clock modem of FIG. 3.

FIG. 4 shows diagrammatically the configuration of a receiver clock modem which is required to acquire polynominal synchronization with the incoming FSK pseudo-random data and then to derive the correct time of day. The received signal at the input 23 of the receiver clock modem is applied to a 1 KHz FSK demodulator 24. The demodulated signal is then connected to the input of a PNG automatic synchronization detector 25 which is connected to a receiver PNG 26. The automatic synchronization detector 25 and the receiver PNG 26 are connected together in a feedback loop such that the receiver PNG 26 is brought into synchronism with the incoming pseudo-random data. Since the incoming data can be degraded by one or more bit errors it is necessary to check whether the synchronization of the receiver PNG 26 has been done correctly. The checking procedure is described below. Once the checking procedure shows that the receiver PNG 26 has been correctly synchronized, the automatic synchronization detector 25 produces a signal at an output 27 which initiates a high speed full cycle 24-hour clock rotation similar to that carried out in synchronizing the transmitter clock modem. The output 27 from the automatic syncronization detector 25 is connected to a clock pulse generator 28 which, on receiving a signal indicating synchronization, produces a train of $8.64\times10^6$ clock pulses. The train of clock pulses is connected to the receiver PNG 26 and to a 24-hour clock 29 which is driven by a 5 mHz reference signal applied to an input 30. The output 31 from the receiver PNG 26 is connected to a detector 32 which produces a reset pulse for the 24-hour clock 29 whenever it detects the pseudo-random number which is at the end of the PNG sequence. The train of pulses from the clock pulse generator 28 therefore rapidly cycles the receiver PNG 26 and the 24-hour clock 29 through the equivalent of 24 hours and when the 2400 hour point is reached in the PNG cycle the reset pulse resets the clock 29. Both the receiver PNG 26 and the 24-hour-clock 29 continue to run at high speed until the 24-hour cycle is complete when the receiver PNG will once again be in synchronism with the incoming polynomial and the 24-hour clock will then display the correct time to within ±5 millisecs (being bit synchronized to within $\pm\frac{1}{2}$ bit). An output 33 from the 24'-hour clock 29 provides a 100 Hz clocking signal for the PNG 26.

Figure 5:
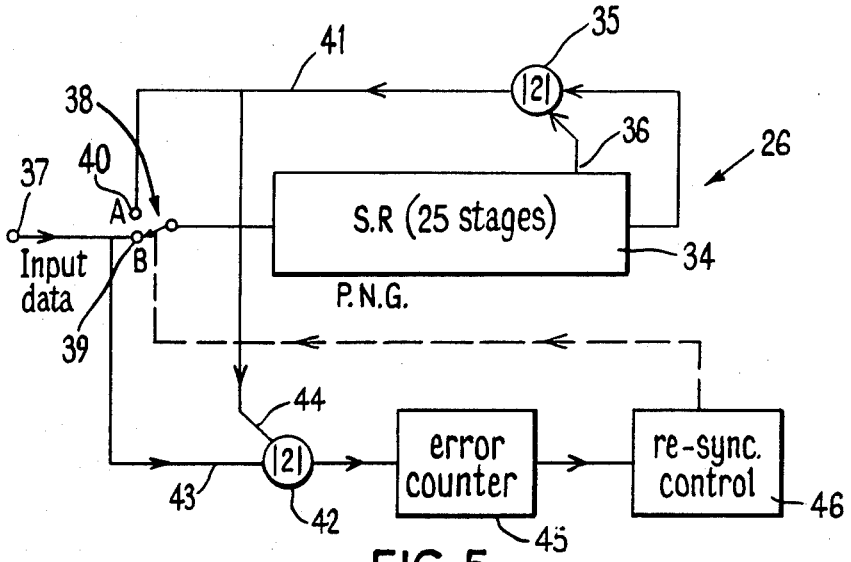
FIG. 5 is a schematic block diagram of a PNG synchronization circuit for use in the receiver clock modem of FIG. 4.
Figure 6:
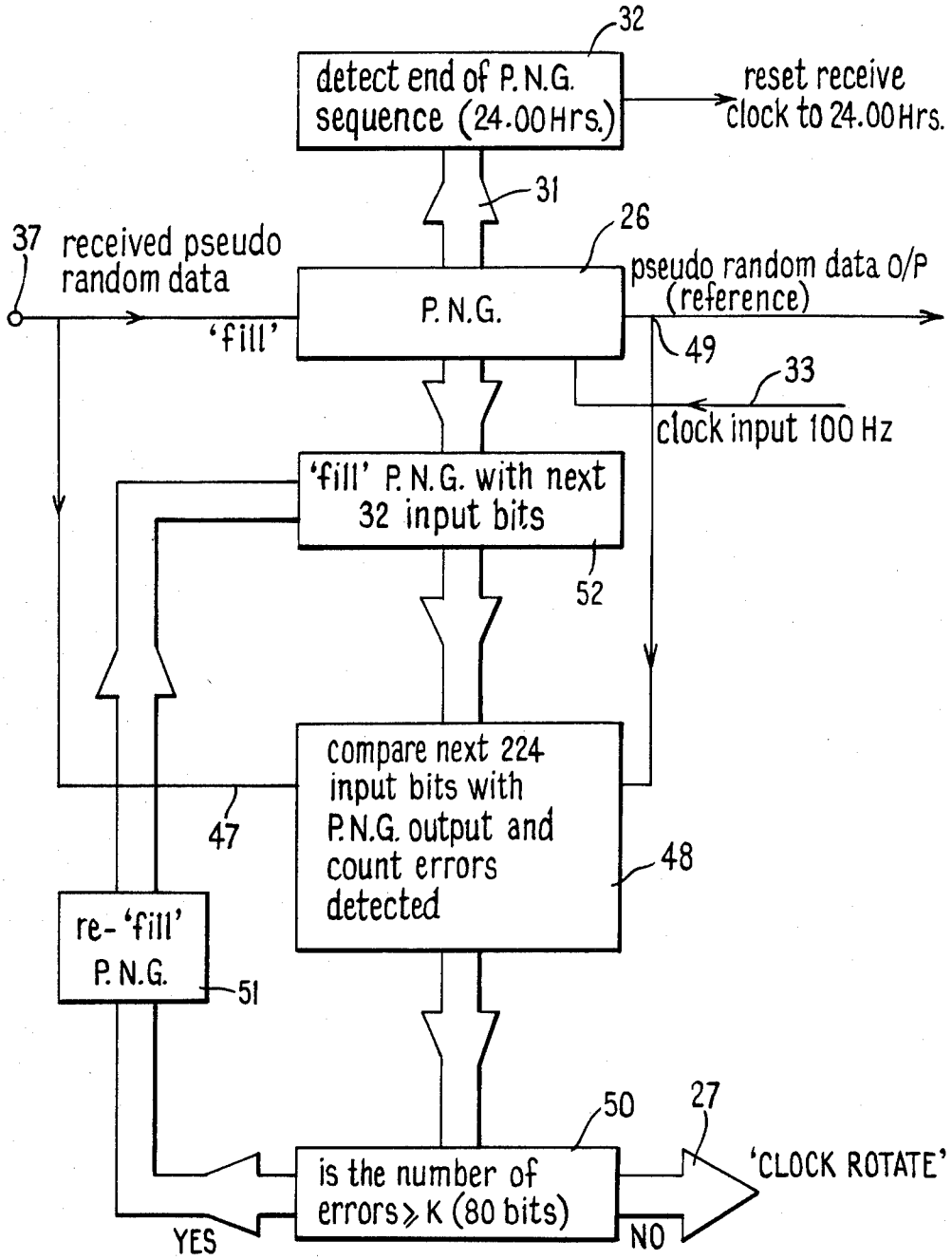
FIG. 6 is a flow chart of one arrangement of a receiver PNG automatic synchronization control circuit.

Synchronization of the receiver PNG 26 with the incoming pseudo-random data is achieved by means of a circuit shown schematically in FIGS. 5 and 6. As in the transmitter clock, the PNG 26 in the receiver comprises a 25-stage shift register 34 with a single modulo-two feedback network 35 taken from the 23rd stage 36 to produce the $8.64\times10^6$ bit maximal length polynomial sequence. The pseudo random numbers signal from the output 37 of the FSK demodulator 24 enters the receiver PNG shift register 34 when an input selector switch 38 is connected to the "Fill" position 39 as shown. The input switch 38 remains in the "Fill" position 39 for a sufficient time until at least twenty-five input data bits have entered the shift register 34. The switch 38 is then connected to position 40 which closes a feedback loop 41 around the shift register 34 to complete the PNG circuit and simultaneously disconnects the input data signal from the shift register. The shift register 34 with the connected feedback loop 41 thus forms the receiver PNG 26 producing an isolated pseudo-random data sequence which can be compared with the input data signal to check that the synchronization has been correctly achieved. If the "Fill" of data into the shift register 34 were free from errors the random data sequence from the receiver PNG 26 would be identical with the transmitted signal. If the "Fill" of data into the shift register 34 is incorrect and/or the subsequently received input signal is corrupted by errors then bit errors will be seen when comparing the output from the receiver PNG with the received signal. These bit errors are counted by connecting the received signal to a first input 43 of a modulo-two circuit 42 with the output from the receiver PNG 26 connected to a second input 44. Whenever a bit error is present a signal is produced at the output of the modulo-two circuit 42. The number of bit errors is then counted by a counter 45 and when the bit error rate (BER) exceeds a preselected threshold an output signal is applied to a re-synchronization control circuit 46 which reverses the position of switch 38 to allow a new "Fill" of input data into the shift register 34. This process is repeated as necessary until the BER indicates than an error-free "Fill" has been obtained.

If the input signal bit error rate is high during a "Fill" the probability of correctly filling the shift register 34 becomes very small but it is still statistically possible. When it does occur the bit errors detected between the receiver PNG 26 and the input signal will be high after the "Fill" because the input signal is still erroneous. When this happens the error rate measured between these two signals will correspond with the BER of the input data signal.

If the "Fill" was incorrect the error rate measured between the PNG sequence and the input signal will always be 50% because both sequences are statistically uncorrelated.

The error rate measured after a "Fill" can therefore be used to indicate the success of the "Fill" operation.

PNG synchronization can be detected because an error rate of 50% will always be produced if the "Fill" was incorrect and an error rate of less than 50% will be produced when the "Fill" is correct. A simple bit error counter is therefore all that is required to indicate if synchronization has been accomplished between the receiver PNG 26 and the input signal. This is illustrated in the FIG. 5 arrangement where the error counter 45 is coupled to a re-synchronization control circuit 46. Theoretically the threshold of the re-synchronization control circuit 46 can be set to just below 50% BER because the error rate will always be 50% if the "Fill" is incorrect. However, a threshold as high as this is impracticable because a very long measurement period will be required to ensure a meaningful reading of BER is taken. If this were not done an incorrect "Fill" might be accepted (as being correct) because the BER measured could be lower than the actual figure. This is due to normal statistical averaging properties and is related to sampling error theory. If this happens the PNG will be unsynchronized and the time of day will be erroneously decoded. If the error threshold is lowered, the time taken to measure the bit error rate can be reduced to a more acceptable figure without increasing the probability of a false synchronization but the receiver PNG 26 will only be allowed to synchronize on input signals having error rates less than this threshold level because the re-synchronization control circuit 46 will continue to instruct a re-fill even when the "Fill" is correct as long as the input BER is above this threshold. A compromise between these two extremes can be made to ensure that the receiver PNG 26 will correctly synchronize in response to an input signal with a reasonably high BER and yet the probability of a false synchronization occurring will be very small.

This compromise is illustrated in FIG. 6. An error rate threshold of 80 in a block of 224 was used because this offered a working noise margin of 36% input BER with a probability of a false synchronization occurring only once in $10^5$ attempts. Once the input data "Fill" into the receiver PNG 26 is complete (in this case 32 input bits) the next 224 input data bits (checking bits) at the input 47 of a comparator 48 are compared to the simultaneous 224 output bits at the output 49 from the receiver PNG 26. The comparator 48 also counts the number of errors detected and in circuit 50 the total is compared with a preset number, 80 in this case. If the total is less than 80 this indicates correct synchronization and a signal is produced at the output 27 to advance the 24-hour clock 29 and the receiver PNG 26 by one complete cycle and thereby set the clock to the correct time of day. If the total number of errors counted by the comparator 48 is greater than 80 indicating incorrect synchronization a signal to initiate refilling of the receiver PNG 26 is produced by a circuit 51 which prompts a control circuit 52 to fill the receiver PNG 26 with the next 32 signal input bits. This procedure is then repeated until correct synchronization is achieved.

Figure 7:
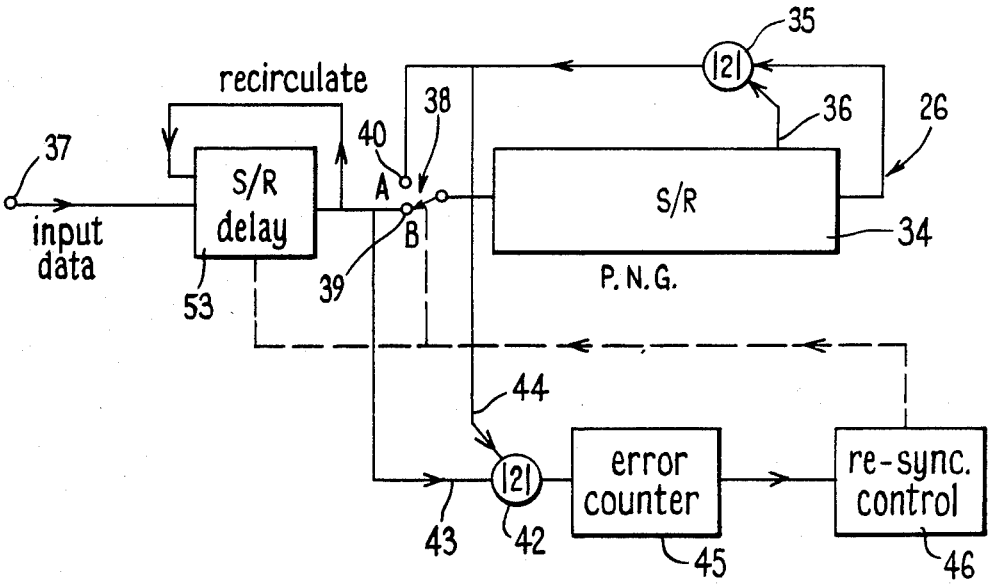
FIG. 7 is a schematic block diagram of a PNG synchonization circuit alternative to that shown in FIG. 5.

FIG. 7 shows how the basic auto-synchronization control circuit of FIGS. 5 and 6 can be modified to speed up the synchronization procedure. This is done by storing the 224 "Fill" checking bits in a high-speed recirculating shift register 53 connected between the data input from the output 37 of the FSK demodulator 24 and the receiver PNG 26.

The error rate measurement taken after the "Fill" can now be done offline at high speed. In this way the synchronization check can be done well within one bit period, eg less than 10 milliseconds.

If the check is satisfactory the data input and the PNG output will be in bit synchronization and the circuit operates as before. If it is incorrect the refill and check is done again. In this way the "Fill" and synchronization checking can be reduced from 2.56 seconds to less than 0.25 seconds.

Figure 8:
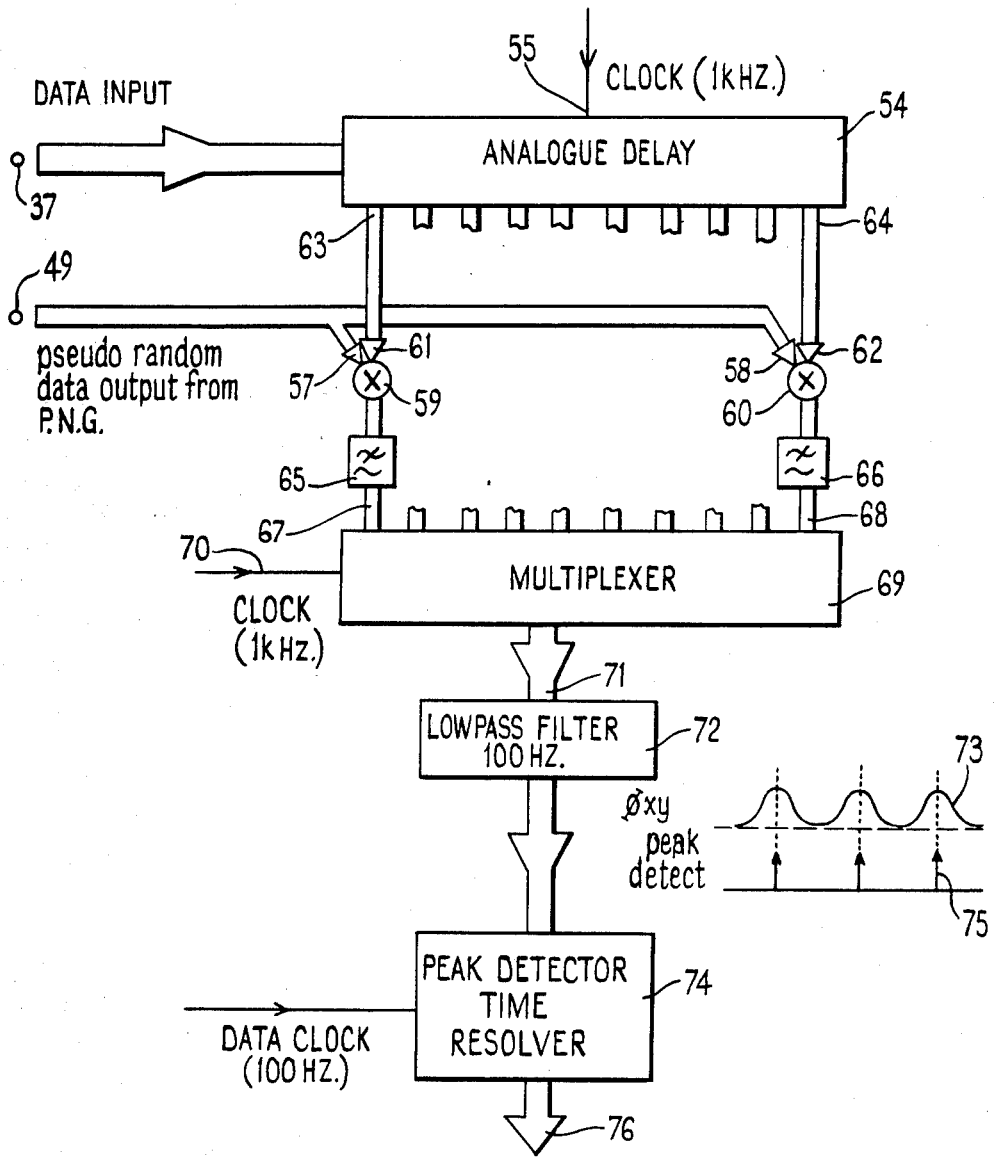
FIG. 8 is a block diagram of a sub-bit time resolver for use with the receiver clock modem and FIG. 9 is a battery clock incorporated in the receiver clock modem.

The accuracy of the receiver clock modem will always be better than ±5 milliseconds because the maximum error between the receiver PNG and the input date signal can only be $\pm\frac{1}{2}$ after synchronization. Bit synchronization in the receiver can be improved to ensure that the time error is normally within ±1 millisecond provided the input signal to noise ratio is better than 0 dB in a 3 kHz bandwidth. This is done by adjusting the phase of the receiver PNG output signal to align with the input data signal. This phasing technique could be made to operate with far higher noise levels but to do so would require much longer averaging periods for filtering and phase locking. This is impracticable because fast initial phase locking followed by a rapid synchronization of the PNG is necessary if the modem is to properly operate over fading and noisy channels. FIG. 8 shows an alternative approach which will provide sub-bit timing resolution without jeopardizing speed of acquisition. This is done by cross-correlating the input signal with the output from the receiver PNG after completing synchronization.

Noise and distortion on the input data signal are minimized by integrating over several seconds. Ten cross-correlation integral values are measured over a 10 millisecond range ($\pm\frac{1}{2}$ bit). From this the relative delay between the input data signal and the receiver PNG signal can be found. The accuracy with which this delay can be measured will depend upon the input signal to noise ratio and the integration time of the cross-correlation process. With an integration time of 1 second, it can be shown that the input signal to noise ratio will have to be −4 dB (in 3 kHz BW) or better for the timing error to be within 100μ seconds for 90% of the time.

It can be similarly shown that, for the modem to operate down to −8 dB carrier to noise and to still retain a timing acquisition accuracy of 100 microseconds or better the integration time will have to be 10 seconds or more. This presupposes a non-dispersive input data signal is used during the measurement period. The received input from the output 37 of the FSK demodulator 24 is provided as an input into a 10-stage 10 msec analogue delay line 54 which has a 1 kHz clocking signal applied to its clock input 55. Thus the time interval between successive stages is 1 msec and the total delay is 10 msec. The 10 msec delay is chosen since this is equal to the time interval between successive bits of the signal data. The pseudo-random data output 49 from the receiver PNG 26 will normally be delayed on the input signal by $\frac{1}{2}$ bit (5 msec.) This delayed output from the receiver PNG 26 is connected in parallel to the first inputs 57–58 of ten multipliers 59–60 of which only two are shown for clarity.

Ten tap outputs 63–64 from the delay line 54 are respectively connected to the second inputs 61–62 of the multipliers. The product outputs from the multipliers 59–60 are respectively applied to integrators 65–66 with their integration times set to at least 1 sec. The outputs from the integrators 65–66 are respectively connected to the taps 67–68 of a 10-stage delay line multiplexer 69 which has a 1 kHz clocking signal applied to its clock input 70. The output 71 is passed through a 100 Hz low pass filter 72 so as to form the envelope of the time-averaged cross-correlation products as indicated by the curve 73. The output from the filter 72 is connected to a peak detector time resolver circuit 74 which is clocked by the 100 Hz clocking signal from the output 33 of the 24-hour clock 29. The time resolver 74 makes a measurement of the peak signal output from the filter 72 in each 10 msec period and then determines the time difference between the data clock pulses and the peak signals 75 measured from the curve 73. The output 76 from the time resolver circuit 74 is an analogue signal which represents the time error within the range ±5 msec to an accuracy of ±100 μsecs.

Figure 9:
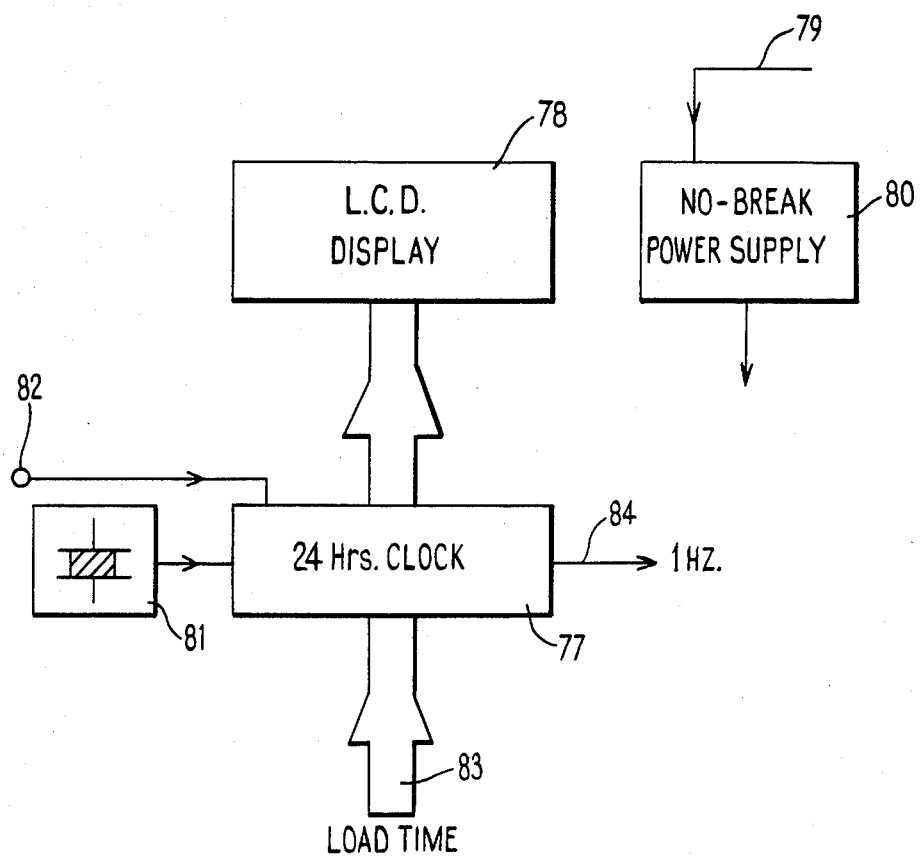

Included in the receiver clock modem is a battery operated clock illustrated in FIG. 9. The battery clock is a 24-hour clock 77 provided with an LCD display 78 powered from the mains 79 by a power supply 80. The power supply 80 includes an 18 amp hour rechargeable battery which provides the battery clock with power for up to 7 days. The 24-hour clock 77 is controlled by a 5 MHz crystal oscillator 81 or it may be connected to an alternative reference source such as a caesium source via a terminal 82. The time of the 24-hour clock 77 is set by means of a Load Time input 83 and a 1 Hz output reference signal is provided at an output 84 for the purpose of checking the timing of the battery clock. Provision of a battery clock confers two advantages. Firstly, it is possible to transport the equipment without any external power supply requirement and secondly it can be desirable to have two independent clocks within the receiver clock modem to provide both absolute and relative time: the battery clock provides absolute time while the transmit clock will provide relative time.

The performance of the modem will ultimately depend on the remote programming facility of the receiver code generator and in particular the ability to achieve only correct synchronization with the input polynomial when operating in the presence of noise or interference.

This is of critical importance when synchronization of the receiver clock PNG is to be done over HF radio circuits so emphasis has been placed on protecting the PNG from achieving incorrect synchronization by incorporating rigorous safeguards in the synchronization detection circuits as described. The performance of the modem can therefore be quantified in two ways.

a. the time taken to achieve correct synchronization; and b. the probability of getting a false synchronization The time taken to get correct synchronization will depend on the input BER and the length of the receiver PNG shift register. The higher the input BER the longer it will take to get synchronization because the probability of getting 25 or more correct input data bits to fill the PNG shift register becomes less likely. The time taken to become synchronized is therefore directly proportional to the number of receiver PNG "Fills" required to guarantee having received at least one (all-correct) 25-bit "Fill".

The time taken to acquire synchronization of the receiver PNG 26 is directly proportional to the number of "Fills" made and as the time taken to fill the PNG and check synchronization is 2.56 secs (256 bits at 100 bits/sec) the synchronization time is 2.56 n secs where n is the number of "Fills" to acquire synchronization when adopting the basic automatic synchronization shown in FIGS. 5 and 6. By setting the error threshold to 80 bits in 224 the probability of obtaining a false synchronization can be shown to be 1 in $10^5$ attempts when the input signal is random noise. If the error threshold were set lower than this the protection against false synchronization could be improved but the probability of detecting correct synchronization would be reduced for erroneous input data with a higher BER. Similarly, if the threshold level were increased, the probability of false synchronization would be higher, but the receiver PNG will now recognise correct synchronization when it occurs even when the input signal bit error rate is much higher than before. A compromise between these two situations was made based on a need to have adequate security against false synchronization but still retaining the ability to detect syrnchronization when the input data error rate is reasonably high.

The invention provides a time code signal format having a narrow transmission bandwidth and an ability to work with poor input signal to noise ratios and yet retain good guarranteed timing accuracy. Such a system is required when an HF skywave radio link is used to cope with fading, multipath and interference from other radio signals but it is also particularly useful for time encoding many other signal forms which have to be recorded before being used. The accuracy of the time clock modem can be improved firstly by introducing a sub-bit timing resolver as is shown in FIG. 8. This technique, however, requires long integration times and is unsuitable if fading or dispersion is present. Secondly, the accuracy can be improved by increasing the transmitted code bit rate. For a 1 kbit/sec code rate the maximum possible timing error can only be $\pm\frac{1}{2}$ millisec. For higher rates the error is reduced proportionally. This method is only acceptable, however, when there are no restrictions limiting the transmitted bandwidth. Although the invention has been described with reference to a simple form of PNG employing only one feedback loop in a 25-stage shift register more sophisticated PNGs could be used to provide a higher degree of orthogonality between different parts of the PNG polynomial sequence. The technique could be applied to a monthly or yearly pseudo-random sequence but in these cases the time to find synchronization would be correspondingly increased compared to a 24-hour polynomial.

As an alternative to extending the pseudo-random number sequence the basic time interval can be extended by using time division multiplexing of the transmitted signal so as to include additional information such as the day, month or year. Thus for example every hundreth bit transmitted could convey this additional information. Since the receiver is capable of maintaining synchronism when the received signal is corrupted by noise the time division multiplexing has no significant effect on the receiver's capability of aquiring the time signals. The receiver can then be provided with a synchronous detector to extract the additional information data bits, and after aquiring several such bits to carry out a simple majority vote to prevent noise corruption of the information.

The invention has been described with reference to FSK Modulation of a 1 kHz reference frequency. FSK has the advantage that it can be sent via national radio transmitters without effecting the broadcasts. It is however possible to use amplitude modulation of a selected tone in a dedicated transmission. By using a single frequency, further information useful to the communications engineer can be extracted from the sub-bit time resolver. Information can be obtained on multipath propagation by looking for the number of peaks in the output from the sub-bit time resolver. A microprocessor may be included and the number of peaks resolved will then indicate the quality of the communications link eg if these are too many modes observed the link cannot operate successfully.

Other modifications of the invention falling within the scope of the accompanying claims will be apparent to those skilled in the art.

I claim:

1. A tranmission clock for transmitting time coded signals comprising:

a transmission pseudo-random number generator (PNG) for generating a train of pseudo-random numbers;

a pulse generator means for producing clocking pulses for input to the transmission PNG such that the generated numbers from the transmission PNG are equi-spaced in time;

a transmission reference clock which produces an output resetting signal at the end of a preselected time interval, the resetting signal being input to the transmission PNG such that the transmission PNG is reset to a predetermined condition, referred to as zero, after the preselected time interval;

synchronizing means which can be actuated to add to the transmission PNG a number of clocking pulses equal to the number of pseudo-random numbers which are generated by the transmission PNG within the preselected time interval and to simultaneously advance the transmission reference clock by the preselected time interval to thereby synchronize the transmission PNG to the transmission reference clock; and means to transmit the output from the transmission PNG.

2. A receiver clock for deriving the time within a preselected time interval from a series of time-coded signals represented by a cyclically repeating train of pseudo-random numbers received from a remote transmitter comprising;

a receiver pseudo-random number generator (PNG) capable of producing an output train of pseudo-random numbers identical with the transmitted train of pseudo-random numbers;

a receiver clock pulse generator connected to the receiver PNG such that the receiver PNG is clocked at the same rate as the transmitted signal;

a detector to receive the transmitted train of pseudo-random numbers;

a synchronizing control circuit to synchronize the receiver PNG to the received train of pseudo-random numbers; and decoding means to derive the time from the output of the receiver PNG.

3. A receiver clock as claimed in claim 2 including means to determine the phase difference between the output signal from the receiver PNG and the received signal, said phase difference being used to correct the time derived from the synchronized output from the receiver PNG.

4. A receiver clock as claimed in claim 2 including a battery-operated clock(77).

5. A receiver clock as claimed in claim 2 wherein the decoding means includes a receiver reference clock to display the derived time and said detector connected to the receiver PNG and responsive to the number generated by the receiver PNG representative of the end of the preselected time interval to produce and output signal to reset the receiver reference clock to zero.

6. A receiver clock as claimed in claim 5 wherein the receiver PNG comprises a shift register having at least one feed-back loop, the synchronizing control circuit including means to feed the received time-coded pseudo-random numbers signal into the receiver PNG shift register and switching means operable between a first position in which the feedback loop is disconnected while the received signal is fed into the receiver PNG shift register and a second position in which the received signal is disconnected from the receiver PNG shift register and the feed-back loop is connected.

7. A receiver clock as claimed in claim 6 wherein there is provided a receiver pulse generator which can be actuated to add to the receiver PNG a number of clocking pulses equal to the number of pseudo random numbers which are transmitted within the preselected time interval and to simultaneously advance the receiver reference clock by the preselected time interval to thereby synchronize the receiver PNG and the receiver reference clock.

8. A receiver clock as claimed in any one of claims 5 to 7 or 2 including comparator means to check the synchronization of the output from the receiver PNG and the received pseudo-random numbers.

9. A receiver clock as claimed in claim 8 wherein the comparator means includes an error counter to count bit errors within a predetermined number of bits; a discriminator to produce an output when the number of bit errors exceeds a predetermined threshold; and a re-synchronizing control operative on receiving said output from said discriminator to reconnect the received signal to the receiver PNG shift register.

* * * * *